US005800659A

United States Patent [19]

Exline et al.

[11] Patent Number: 5,800,659

[45] Date of Patent: Sep. 1, 1998

[54] WALLET SIZE CARD BOOK

[75] Inventors: William B. Exline, Chagrin Falls; Michael P. Exline, Novelty, both of Ohio

[73] Assignee: William Exline, Inc., Cleveland, Ohio

[21] Appl. No.: 779,327

[22] Filed: Jan. 6, 1997

Related U.S. Application Data

[62] Division of Ser. No. 418,567, Apr. 7, 1995, Pat. No. 5,595,401.

[51] Int. Cl.[6] ..... B32B 31/18; B32B 31/20

[52] U.S. Cl. ..... 156/250; 156/290; 156/291; 156/581; 281/31

[58] Field of Search ..... 156/250, 256, 156/290, 291, 580, 581; 281/2, 3.1, 5, 15.1, 31

[56] References Cited

U.S. PATENT DOCUMENTS

| | | | |
|---|---|---|---|
| 286,650 | 10/1883 | Talcott . | |
| 807,648 | 12/1905 | Wiggins . | |
| 1,912,710 | 6/1933 | Kennedy . | |
| 2,294,796 | 9/1942 | Moulder | 156/290 |
| 2,643,777 | 4/1953 | Berger | 150/59 |
| 2,718,911 | 9/1955 | Solomon | 150/39 |
| 2,722,369 | 11/1955 | Reuter | 156/290 |
| 2,767,756 | 10/1956 | Niles | 150/39 |
| 3,172,687 | 3/1965 | Lawrence | 281/31 |
| 3,201,146 | 8/1965 | Tilton, Jr. | 281/31 |
| 3,310,321 | 3/1967 | Freund | 281/31 |
| 3,360,027 | 12/1967 | Price | 150/39 |
| 3,433,279 | 3/1969 | Seamon | 150/39 |
| 3,537,728 | 11/1970 | Reese | 281/31 |
| 4,125,190 | 11/1978 | Davie, Jr. et al. | 156/290 |
| 4,216,979 | 8/1980 | Janik | 283/58 |
| 4,492,390 | 1/1985 | Jacobs et al. | 281/31 |
| 4,586,729 | 5/1986 | Beylerian | 281/5 |
| 4,620,725 | 11/1986 | Maehashi | 281/45 |
| 4,621,729 | 11/1986 | Jackson | 206/37 |
| 4,896,027 | 1/1990 | Drexler | 235/488 |
| 5,143,405 | 9/1992 | Daneshavar | 281/31 |
| 5,156,898 | 10/1992 | McDonald | 428/100 |
| 5,362,103 | 11/1994 | Bromberg | 281/29 |
| 5,431,449 | 7/1995 | Arimoto et al. | 281/31 |

OTHER PUBLICATIONS

William Exline, Inc. brochure; Jan. 1995.

*Primary Examiner*—Michael W. Ball
*Assistant Examiner*—Michael A. Tolin
*Attorney, Agent, or Firm*—Rhodes, Coats & Bennett L.L.P.

[57] ABSTRACT

A wallet size card book which has been adapted to hold a card having the dimensions of a conventional credit card, and is particularly designed to be carried in the credit card compartment of a wallet or similar size compartment holder. The use of a resin emulsion adhesive, a vinyl acetate ethylene copolymer emulsion, in the card book makes it possible to create a properly formed pocket closed on three sides for holding and protecting the card.

9 Claims, 2 Drawing Sheets

WALLET SIZE CARD BOOK

This application is a division of application No. 08/418,567, filed Apr. 7, 1995, which will issue into Letters Pat. No. 5,595,401 on Jan. 21, 1997.

BACKGROUND OF THE INVENTION (1) Field of the Invention

The present invention relates generally to an article designed to hold and protect identification, credit, debit, and other smart cards, and any information encoded on a magnetic stripe or microchip. More particularly, the present invention relates to a wallet size card book which has been constructed to fit within the credit card compartment of a wallet or similar type cardholder.

(2) Description of the Prior Art

Various booklets or folders having card holder pockets and a place to record information or transactions are currently in use. For example, U.S. Pat. No. 5,143,405 (Daneshvar) discloses a booklet for collecting and presenting personal medical information. Although the booklets include pockets formed in the covers of the booklets, the disclosure provides that the pockets may be used to hold additional papers containing medical information. The suggested size of the booklet is approximately 4"×6⅛", and by size alone, would not conveniently fit into the user's wallet. Further, there is no indicated use of the pockets for holding identification and credit cards.

U.S. Pat. No. 4,621,729 (Jackson) discloses a patient medical information and education container which may be wallet size. Although a pocket is provided which serves to hold a plurality of cards or the like, the user must open a plurality of panels of the container to retrieve a card from the pocket.

U.S. Pat. No. 2,767,756 (Niles) discloses a foldable unit plastic card holder designed to hold a number of cards. However, the card holder does not include any pages on which to record transactions or maintain record-keeping.

U.S. Pat. No. 3,360,027 (Price) discloses a ticket and money holder provided with openings with arcuate lower edges through which tickets and the like may be inserted into and removed from the holder. The holder includes an outer sheet which is stitched to a filler.

Standard size card books are also available, for example, savings and passbooks. However, these card books are too cumbersome in size to fit within the compartments of a wallet. Moreover, attempts to produce wallet size card books have been unsuccessful because a sufficient area does not remain to obtain a strong glue bond. Thus, there remains a need for a new and improved wallet size card book which is sized to fit within a wallet but is strong enough to survive normal usage.

SUMMARY OF THE INVENTION

The present invention is directed to a wallet size card book which has been adapted to hold a card having the dimensions of a conventional credit card, and is particularly designed to be carried in a wallet or similar type compartment holder. The invention overcomes existing card type booklets by providing a smaller size card book having dimensions of approximately 2 ½ inches by 3½ inches. Further, the use of a resin emulsion adhesive, a vinyl acetate ethylene copolymer emulsion, in the card book makes it possible to create a properly formed pocket on three sides of the card book for holding and protecting the card. In this regard, the leaves or pages are stitched, stapled or glued to the center of the card book, and a first leaf and two edges of a second leaf are glued to the inner surface of the card book cover, thereby forming a pocket for the card.

Accordingly, one aspect of the present invention is to provide a wallet size card book including: (a) a cover having a fold which divides the cover into a front cover panel and a rear cover panel; (b) a plurality of leaves attached at the fold, the leaves forming pages; (c) a L-shaped glue strip extended along two edges of the inner surface of the cover; and (d) a pocket formed by a first leaf sealed to the inner surface of the cover and cut shorter and narrower than the cover, a second leaf sealed along two edges to the L-shaped glue strip on the cover with a third edge secured to the fold by stitching, gluing or stapling, and a fourth edge remaining open for receiving a credit or information card.

Another aspect of the present invention is to provide a glue strip for sealing leaves of wallet size card books formed from a copolymer emulsion, wherein the copolymer emulsion is vinyl acetate ethylene copolymer emulsion.

Still another aspect of the present invention is to provide a wallet size card book including: (a) a cover having a fold which divides the cover into a front cover panel and a rear cover panel and allows the front and rear cover panels to be opened and closed; (b) a plurality of leaves attached at the fold of the cover, the leaves forming pages having printed matter and blank spaces for record-keeping; (c) a L-shaped glue strip extended along two edges of the inner surface of the cover, the glue strip comprising a copolymer emulsion; (d) a pocket formed by a first leaf being completely sealed to the inner surface of the cover and cut shorter and narrower than the cover, a second leaf being sealed along two edges to the L-shaped glue strip on the cover, a third edge remaining attached to the fold by stitching, gluing, or stapling and a fourth edge remaining open for receiving the wallet size card; and (e) arcuate recesses in the upper edges of the cover and leaves to facilitate the insertion and removal of the wallet size card from the pocket.

These and other aspects of the present invention will become apparent to those skilled in the art after a reading of the following description of the preferred embodiment when considered with the drawings.

DESCRIPTION OF THE PREFERRED EMBODIMENTS

Figure 1:
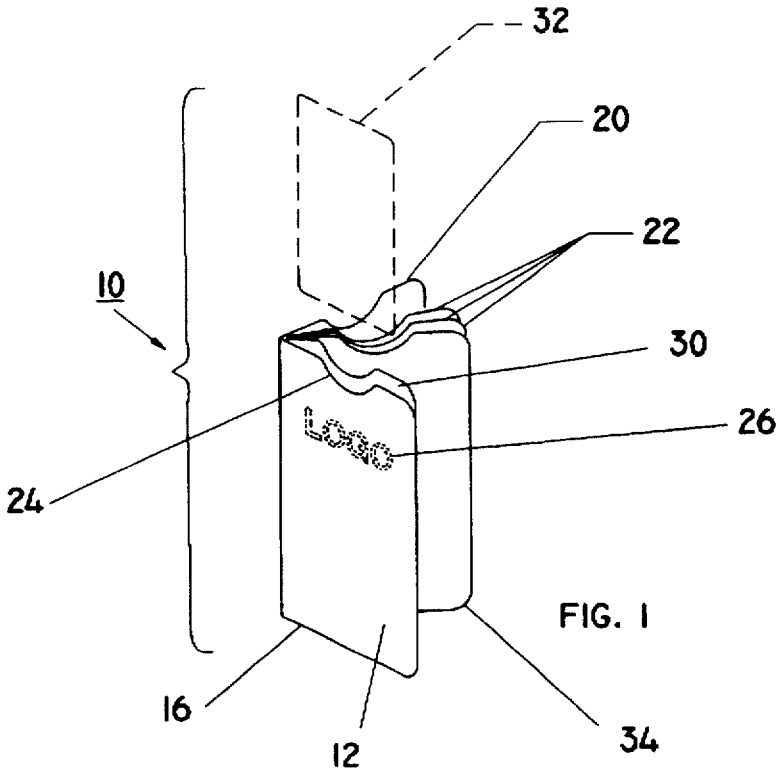
FIG. 1 is a perspective view of a wallet size card book constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 6:
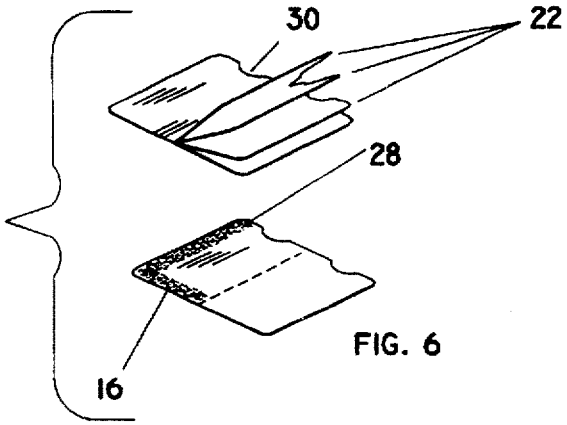
FIG. 6 is an exploded perspective view of the wallet size card book.

Referring now to the drawings in general and FIG. 1 in particular, it will be understood that the illustrations are for the purpose of describing a preferred embodiment of the invention and are not intended to limit the invention thereto. As best seen in FIG. 1, the wallet size card book, generally designated 10, comprises a cover 12 having a fold 14 which divides the cover into a front cover panel 16 and a rear cover panel 20, a plurality of leaves 22 attached at fold 14, with the leaves forming pages, and a L-shaped glue strip 28 (shown in FIG. 6) formed along two edges of the inner surface of at least one cover panel. The card book 10 further includes arcuate recesses 24 in the upper edges of the cover 12 and plurality of leaves 22. Cover 12 comprises a lexide material, and indicia 26, for example, a logo, may be placed on the front cover panel 16 of the book. The card book 10 also includes a pocket 30 for holding and protecting a wallet size credit card 32 or comparable size information card.

Pocket 30 of the card book 10 is formed by a first leaf being sealed completely to the inner surface of the cover 12 and cut shorter and narrower than the cover, a second leaf being sealed along two edges to the L-shaped glue strip 28 on the inner surface of cover 12 with a third edge attached at fold 14 by stitching, gluing or stapling and a fourth edge remaining open for receiving the card 32.

The L-shaped glue strip 28 comprises a resin emulsion adhesive (Evans No. 04053, Evans Adhesive Corp., Columbus, Ohio). The composition of Evans No. 04053 comprises a vinyl acetate ethylene copolymer emulsion. The adhesive may include other additives, for example, a defoamer. The copolymer emulsion is water-based and contains approximately 45% water, and the vinyl acetate ethylene copolymer emulsion content is approximately >95.0 wt. %. It is contemplated that any comparable adhesive may be used as the L-shaped glue strip. The thickness of the glue strip ranges between 1/16 inch to about 1/4 inch. The glue strip preferably extends approximately 1/16 inch from the bottom edge of the inner surface of cover 12 to about 3/16 inch from the side edge of the inner surface of cover 12.

Figure 2:
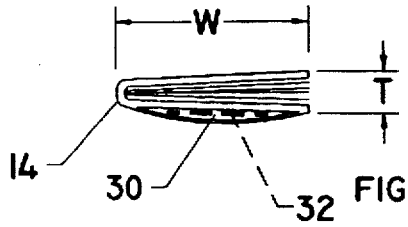
FIG. 2 is a top view of the wallet size card book.
Figure 3:
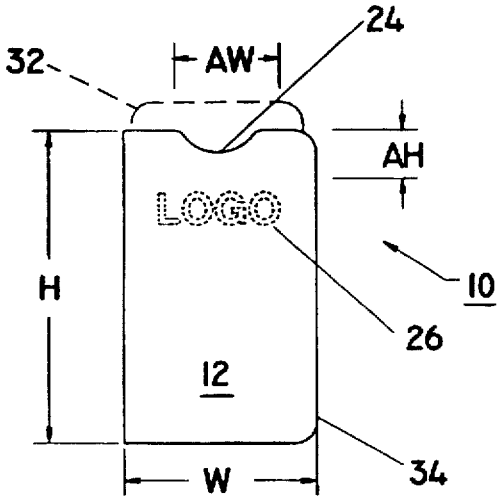
FIG. 3 is a front view of the front cover panel of the wallet size card book.
Figure 4:
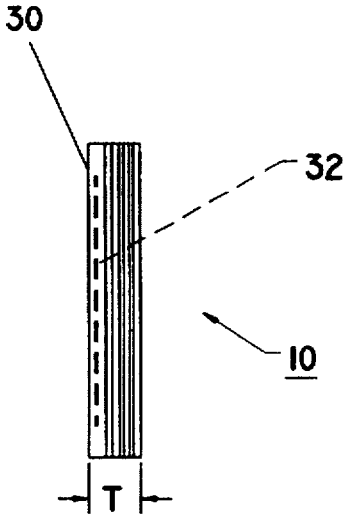
FIG. 4 is a side view of the wallet size card book.

As shown in FIG. 3, the book 10 has upper and lower rounded edges 34 opposite the fold 14. Rounded edges 34 are between about 1/8 inch to 3/8 inch in diameter, with a preferred diameter of 1/4 inch. The height H of book 10 ranges between approximately 3 5/16 inches to about 3 5/8 inches, with a preferred height of 3 1/2 inches. The width W of book 10 ranges between about 2 3/8 inches to about 2 5/8 inches, with a preferred width of 2 1/2 inches. As shown in FIGS. 2–4, the thickness T of book 10 ranges between about 1/16 inch to about 3/16 inch with a preferred thickness of 1/8 inch.

Again referring to FIG. 3, the arcuate recesses 24 have a width AW ranging between approximately 7/8 inch and 1 1/8 inches, with a preferred width of 1 inch. The depth AH of recess 24 ranges between 3/16 inch and 3/8 inch, with a preferred depth of 1/4 inch. The arcuate recesses facilitate the insertion and removal of card 32 from pocket 30.

Figure 5:
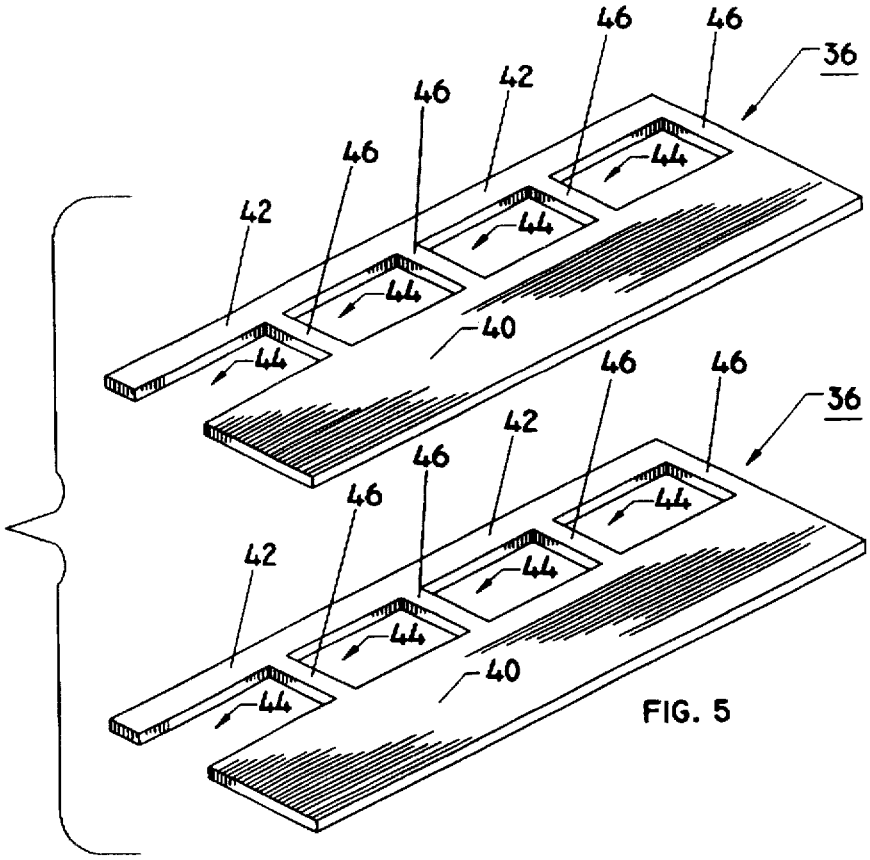
FIG. 5 is a perspective view of the upper and lower dies.

In producing card book 10 in accordance with the present invention, at least one card book 10 is placed in an open position where the plurality of leaves 22 are attached to fold 14 of the cover 12. The first or fly leaf is cut shorter and narrower than the cover 12 so that when the resin emulsion adhesive is applied to the entire inner surface of at least one cover 12, the first leaf completely adheres to the cover 12, and leaves and L-shaped glue strip 28 exposed along the marginal edges of the inner surface of cover 12. As a result, a second leaf adheres to the L-shaped glue strip 28 that remains exposed on the inner surface of cover 12, thereby forming a pocket with a third edge being attached at fold 14 and a fourth edge remaining open for receiving a card 32. In one embodiment of the invention, three books are placed end to end in an upstate position. During the process, anywhere from approximately 12–18 books may be placed between two dies 36 of the type shown in FIG. 5 immediately after the resin emulsion is applied. Die 36 includes a lower strip 40 and an upper narrow strip 42. A plurality of openings 44 exists between the upper and lower strips 40,42. Between adjacent openings 44 are adjoining strips 46.

The books and dies are placed in an air-powered vise, and thereafter squeezed together in order to set the adhesive. The vise is squeezed under approximately 2800 lbs/in$^2$ of pressure for a sufficient amount of time in which to properly seal the adhesive to the cover 12. The pressure may range between about 2000 and 4000 lbs/in$^2$. In a preferred embodiment, the vise may be squeezed between about 30 seconds and about one minute. The dies 36 function by applying pressure around the outer edges of the leaves, and help to seal the adhesive on the cover 12 of card book 10. As a result, a pocket 30 is created which is formed by sealing the first leaf and part of the second leaf to the inner surface of cover 12 using the L-shaped glue strip 28.

Certain modifications and improvements will occur to those skilled in the art upon a reading of the foregoing description. By way of example, it is contemplated that the card book of the present invention can be modified for use in a variety of industries including but not limited to financial institutions, telecommunications, healthcare, information security, travel and hospitality and prepaid vending. The card book may, thus, be customized to hold information about a particular organization and its services, programs, etc.

It should be understood that all such modifications and improvements have been deleted herein for the sake of conciseness and readability, but are properly within the scope of the following claims.

We claim:

1. A method for making a wallet size card book, comprising the steps of:

(a) positioning a cover and a plurality of leaves together in an open position to form at least one card book;

(b) securing the cover to the plurality of leaves by stitching along a mid-point;

(c) cutting a first leaf shorter and narrower than the cover;

(d) applying a resin emulsion adhesive to the inner surface of the cover;

(f) placing the card book and at least two dies in a vise;

(g) squeezing the vise under pressure for a sufficient amount of time to seal the first leaf and two edges of a second leaf to the inner surface of the cover, forming a pocket for holding a wallet size card.

2. The method of claim 1, wherein the resin emulsion adhesive is a vinyl acetate ethylene copolymer emulsion.

3. The method of claim 2, wherein the resin emulsion adhesive includes additives.

4. The method of claim 3, wherein the additives include a defoamer.

5. The method of claim 1, wherein the resin emulsion adhesive forms an L-shaped glue strip along two edges of the inner surface of the cover.

6. The method of claim 5, wherein the L-shaped glue strip extends across a bottom and side edge of the inner surface of at least one cover.

7. The method of claim 1, wherein the pressure of the vise ranges between approximately 2000 and 4000 lbs/in$^2$.

8. The method of claim 1, wherein the vise is squeezed between about 30 seconds and about 1 minute.

9. The method of claim 1, wherein steps (a) through (d) are repeated to make a plurality of card books, the plurality of card books is placed between the dies at step (f), and the vice is squeezed at step (g) to form a pocket for holding a wallet size card on each card book.

* * * * *

UNITED STATES PATENT AND TRADEMARK OFFICE

CERTIFICATE OF CORRECTION

PATENT NO. : 5,800,659

DATED : September 1, 1998

INVENTOR(S) : Exline, et al.

It is certified that error appears in the above-identified patent and that said Letters Patent is hereby corrected as shown below:

Claim 1(f), line 39, change '(f)' to '(e)'.

Claim 1(g), line 40, change '(g)' to '(f)'.

Claim 9, line 61, change '(f)' to '(e)'.

Claim 9, line 62, change '(g)' to '(f)'.

Signed and Sealed this

Eleventh Day of May, 1999

*Attest:*

Q. TODD DICKINSON

*Attesting Officer*

*Acting Commissioner of Patents and Trademarks*